US006581998B1

(12) United States Patent
Clemens

(10) Patent No.: US 6,581,998 B1
(45) Date of Patent: Jun. 24, 2003

(54) CARRIER APPARATUS FOR FIRE FIGHTERS

(76) Inventor: R. Michael Clemens, 3441 Damascus Rd., Brooke-ville, MD (US) 20833

( * ) Notice: Subject to any disclaimer, the term of this patent is extended or adjusted under 35 U.S.C. 154(b) by 0 days.

(21) Appl. No.: 10/073,381

(22) Filed: Feb. 12, 2002

(51) Int. Cl.[7] ..... B65D 71/00; A61G 1/00
(52) U.S. Cl. ..... 294/141; 294/152; 5/626
(58) Field of Search ..... 294/137, 138, 294/140, 141, 149–157, 165; 5/625, 626

(56) References Cited

U.S. PATENT DOCUMENTS

| | | | | | |
|---|---|---|---|---|---|
| 544,074 | A | * | 8/1895 | Webster | 294/140 |
| 722,456 | A | * | 3/1903 | Reeves | 5/187 |
| 2,784,890 | A | * | 3/1957 | Chisholm | 294/152 |
| 2,789,571 | A | | 4/1957 | Kurman | |
| 3,942,636 | A | * | 3/1976 | Matsuyama et al. | 206/349 |
| 4,425,000 | A | * | 1/1984 | Keck, Jr. | 294/151 |
| 4,442,557 | A | | 4/1984 | Clemens | |
| 4,478,452 | A | | 10/1984 | Clemens | |
| 5,800,001 | A | * | 9/1998 | Anastasi | 294/141 |

* cited by examiner

*Primary Examiner*—Dean J. Kramer
(74) *Attorney, Agent, or Firm*—Donald A. Kettlestrings

(57) ABSTRACT

An improved carrier apparatus for use by fire fighters to carry fire hose and to serve as a personnel carrier includes an elongate bottom, a first end wall connected to the bottom and first and second opposed and spaced apart side walls connected to the bottom and to the first end wall. A second fire hose retaining end wall is movably connected to the first side wall for removable connection to the second end wall. A gap is formed between a lower edge of the second end wall and the elongate bottom when the second end wall is removably fastened to the second side wall to permit water and debris to pass out through the gap while preventing the fire hose from falling out of the carrier prematurely.

1 Claim, 2 Drawing Sheets

CARRIER APPARATUS FOR FIRE FIGHTERS

BACKGROUND OF THE INVENTION

This invention relates to a carrier apparatus and more particularly to a carrier apparatus for use by fire fighters both as a carrier for fire hose and as a carrier for a person.

It is often necessary for a fire fighter to carry a length of hose from the fire truck to a distant location, where the hose will be put in use. For example, where a fire occurs in a high-rise building, shopping mall, large department store, in subway stations and in parking garages, it is necessary to carry the hose into the structure, and to then connect it to a stand pipe, and to deploy it so that water may be directed at the fire. Other instances where the carrying of a fire hose is required are where the fire occurs in a rural location, and it is necessary to transport the fire hose to a suitable source of water, such as a pool, stream or pond.

It is highly desirable that minimum time be consumed between the arrival at the site of the fire by the firemen and the discharging of water on the fire, and so the fire hose must be readily carried, and a suitable length must be carried by a single fire fighter in many instances. Further, it is necessary that the hose be paid-out rapidly and without requiring the handling of the hose at the carrier by a second fire fighter, while one fire fighter is moving with the nozzle, connected to the fire hose, towards the fire.

Among the problems which face firemen in fighting fires is the necessity for removing victims from the site of the fire, and the most facile way of handling this problem has been the calling for a stretcher by the fireman who has located the victim. This is often time consuming, especially where the fire is at a remote location from the fire engine on which the stretcher is stored, thereby necessitating an additional trip for a hard-pressed fire fighter from the fire site to the fire engine to procure the stretcher. A delay can also occur while a separate part of the fire fighting crew is directed to bring a stretcher to the site where the victim is located.

Clemens, U.S. pat. Nos. 4,442,557 and 4,478,452 incorporated herein by reference, describe a carrier apparatus for use by fire fighters which are currently being used successfully by many fire departments. Although these carriers are serving the purpose for which they were designed, they have not proved entirely satisfactory under all conditions of service for several reasons. For example, the carrier described in those patents provides for an open end at the end opposite end wall 12. As a result, a fire hose can fall out of the carrier 10 prematurely. Also, having handles 24*a*, 24*b*, 26*a* and 26*b* only at the ends of carrier 10 makes it difficult for a single fireman to lift and move carrier 10 from one place to another. The absence of a pocket or sleeve on carrier 10 also has required a fireman to carry tools, such as elevator keys and hose spanners, on his person.

It is, therefore, an object of the present invention to provide a carrier apparatus for use by fire fighters which incorporates a movable end flap for retaining a hose within the carrier while enabling water and debris to pass out from the carrier through a gap between the movable flap and a bottom of the carrier.

Another object is to provide such a carrier apparatus which is designed to be carried by a single fire fighter by means of handles centrally positioned on the carrier apparatus.

A further object of the invention is the provision of such a carrier apparatus which includes a pocket or sleeve attached to an exterior surface of the carrier for receiving and storing support tools, such as elevator keys and a small hose spanner, so that the tools can be conveniently carried with the first-in equipment for fighting a high-rise building fire.

Still another object is to provide such a carrier apparatus which can be used as a carrier for fire hose and as a carrier for a fire victim.

A still further object is to provide such a carrier apparatus which is comprised of a flaccid material so that the carrier apparatus can be readily collapsed and folded for easy transportation and storage when not in use.

Still another object is to provide such a carrier apparatus which includes carrier handles at both ends of the apparatus to facilitate lifting and movement of the carrier by more than one fire fighter.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides carrier apparatus for use by fire fighters, the apparatus comprising: an elongate bottom, a first end wall connected to the bottom and first and second opposed and spaced apart side walls connected to the bottom and to the first end wall; a second end wall movably connected to the first side wall; first means in operative relationship with the second end wall and with the second side wall for removably fastening the second end wall to the second side wall; a plurality of handles connected to each of the first and second side walls for lifting and carrying the carrier apparatus and any load supported by the carrier apparatus; a plurality of straps connected to one of the side walls and extending to the other one of the side walls; and second means in operative relationship with the straps and with the other one of the side walls for releasably securing the straps to the other one of the side walls.

It is to be understood that both the foregoing general description and the following detailed description are exemplary and explanatory but are not restrictive of the invention.

BRIEF DESCRIPTION OF THE SEVERAL VIEWS OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE INVENTION

Figure 1:
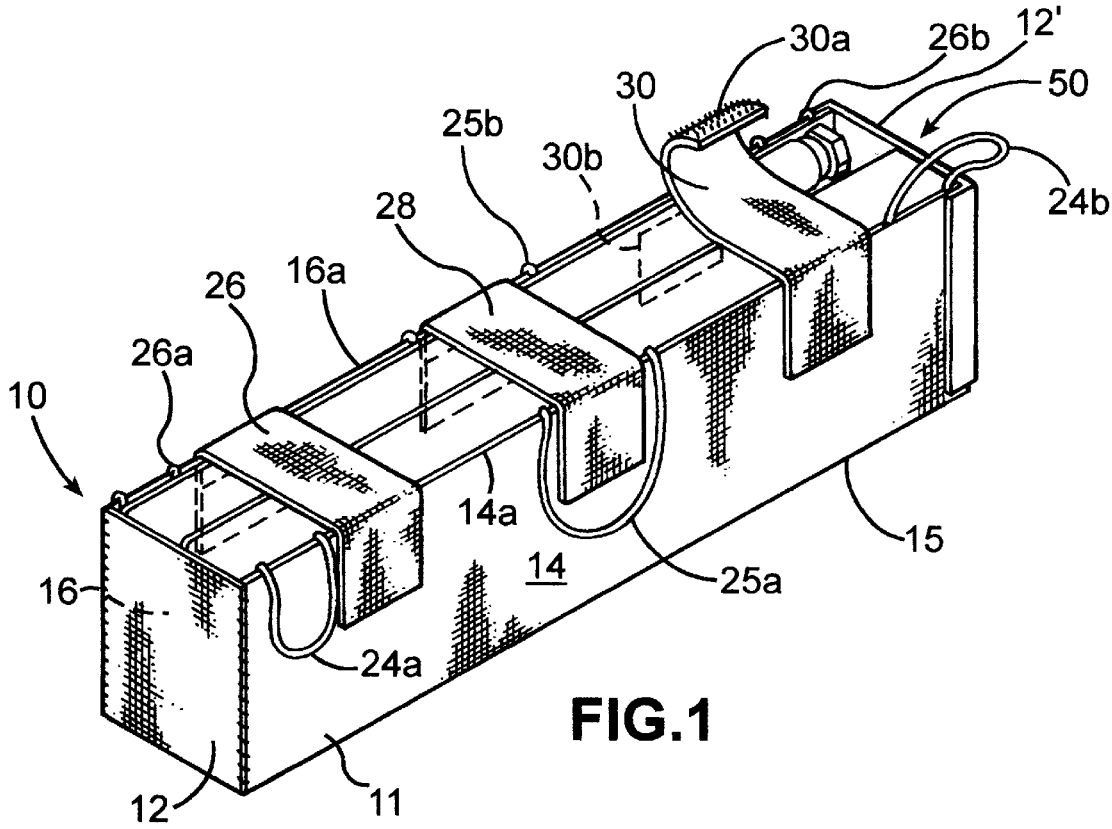
FIG. 1 is a front perspective view of a carrier and hose in accordance with the present invention.
Figure 2:
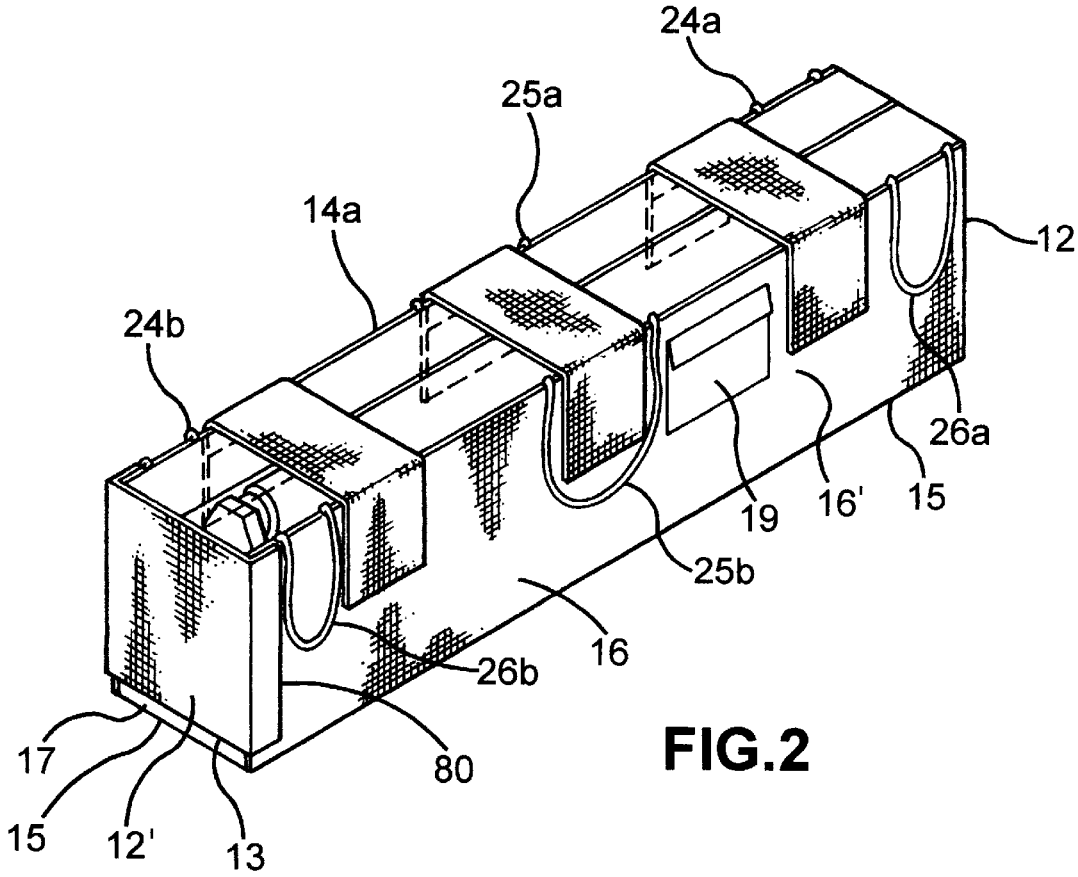
FIG. 2 is a rear perspective view of a carrier and hose in accordance with the present invention.

With reference now to the drawings, wherein like reference characters designate like or corresponding parts throughout the several views, there is shown a carrier apparatus 10 which comprises an elongate carrier body 11 that is made of suitable flaccid material. Such material is strong, abrasion-resistant, and water impervious. Various materials of suitable character are known, and these include Nylon, or fabric impregnated with Nylon, and materials having various coatings.

At one end of carrier body 11 there is provided a first end wall 12 connected in a conventional manner to bottom 15. A first side wall 14 is connected in a conventional manner to end wall 12 and to bottom 15. Opposite side wall 14, and generally parallel to it, is a second side wall 16 connected in a conventional manner to end wall 12 and to bottom 15. Side walls 14 and 16, at the portions thereof adjacent end wall 12, are substantially perpendicular to end wall 12 and they are also substantially perpendicular to bottom 15.

Remote from bottom 15, side wall 14 has a free edge 14*a*, and substantially parallel thereto is a free edge 16*a* of side wall 16. Carrier body 11 is open at the top, between edges 14*a* and 16*a*, and can also be open at the end opposite end wall 12.

Apparatus 10 further includes a second end wall 12' movably connected to first side wall 14. End wall 12' can be sewn or otherwise conventionally attached to side wall 14 to permit end wall 12' to be moved relative to wall 14.

In accordance with the invention, first means 80 are provided in operative relationship with second end wall 12' and with second side wall 16 for removably fastening second end wall 12' to second side wall 16. First means 80 preferably includes hook and loop type fasteners, such as Velcro, connected to end wall 12' and to side wall 16, respectively.

Side wall 14 is provided with a pair of handles 24*a*, 24*b*, and there are corresponding handles 26*a*, 26*b* on side wall 16. In addition, handles 25*a*, 25*b* are connected to side walls 14, 16, respectively, but substantially midway between end walls 12, 12'. Each of the handles of apparatus 10 is substantially identical and is in the form of a loop, portions of which are suitably secured to side walls 14, 16.

Extending across the open space between side walls 14 and 16, remote from bottom 15 of carrier body 11, and transversely of the edges 14*a* and 16*a*, are securing straps 26, 28 and 30. These straps are each securely attached in a conventional manner at one end to side wall 14, and have, at their opposite ends, a pad of fastening material, such as pad 30*a* shown in FIG. 1. A corresponding pad 30*b* is shown on side wall 16, and corresponding pads are provided for straps 26 and 28. The pads are preferably made of Velcro.

In accordance with the invention, second end wall 12' defines a lower edge 13, and lower edge 13 is normally spaced apart from bottom 15 to form a gap 17 therebetween when second end wall 12' is removably fastened to second side wall 16. Water and debris, which tends to collect within apparatus 10 during use, can pass out through gap 17 to prevent trapping and collecting of water and debris within apparatus 10 while end wall 12' holds the hose in position within apparatus 10.

Second side wall 16 defines an exterior surface 16', and apparatus 10 further includes a pocket or sleeve 19 connected to surface 16' for receiving and storing small tools, such as elevator keys and a hose spanner.

Within carrier body 11 there is provided a length of fire hose 50, which is positioned in two fan-fold stacks, placed side by side, fire hose 50 being continuous.

The length of carrier body 11 is at least equal to the major portion of the length of the body of an adult. For example, the length of carrier body 11 is preferably such that an adult of six feet or more in height will have his head, body, upper legs and lower legs as far as the calves, supported when placed in or on carrier body 11 with his head adjacent end wall 12.

Figure 3:
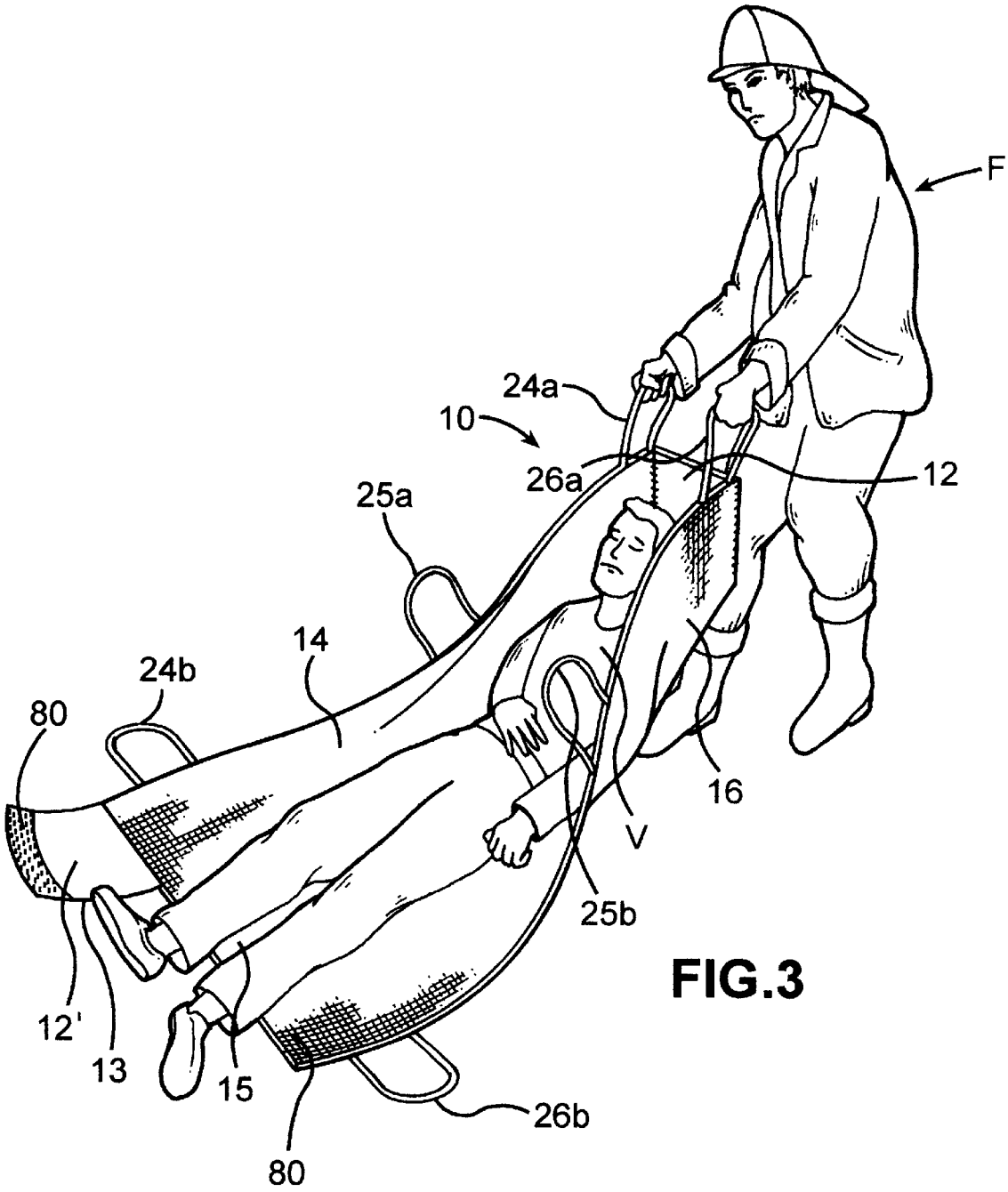
FIG. 3 is a perspective view of the carrier of this invention shown as a person transporter.

Referring now to FIG. 3, there is shown carrier 10 being used as a device to remove a victim from the scene of a fire. As shown, victim V is positioned so that his back is against bottom 15 with his head substantially adjacent to end wall 12. If there is only one fire fighter F available, the victim may be dragged from the place of danger, by the fire fighter F pulling on handles 24*a* and 26*a*, which are located adjacent end wall 12. End wall 12 has a width of approximately seven inches so that the portions of side walls 14 and 16 which are adjacent end wall 12 will be spaced that same distance, and thereby tend to cradle or cushion the head of the victim V between them. It will be noted that the length of carrier 10 is such that it will underlie almost the entire length of the victim V, terminating approximately at the calves of the victim V.

Bottom 15 is preferably padded to cushion the victim, and the padding of bottom 15 also serves to make more comfortable the carrying of apparatus 10 when it is necessary for the fireman to place it on his shoulder and to carry it. The height of end wall 12 and side walls 14, 16 are such as to accommodate a substantial length of fire hose 50, and in practice, this height is preferably about ten inches.

While carrier body 10 is suitable for use to transport a victim where there is only one fireman available, it is preferred to transport the victim by two, or even four, firemen, if such additional firemen are available. In that case, use will be made of handles 24*b* and 26*b*, so that the victim is not dragged, but is lifted. While a portion of the legs of the victim will extend beyond the end of carrier body 11, the lower end of the legs will be substantially in line with the thighs of the legs, and will not hang down, since the lower portions of the legs of the victim will be supported at least to approximately the calves of the legs.

When carrier apparatus 10 is to be transported by a fireman from the fire truck, it may be placed on the shoulder of a single fireman, some comfort being provided by the padding of bottom 15. Centrally located handles 25*a*, 25*b* allow one fire fighter to lift and move carrier 10 from one place to another. The centrally located positions of handles 25*a*, 25*b* allow carrier 10 to be balanced when lifting by one fire fighter. Centrally positioned handles 25*a*, 25*b* will make it easier for a single fire fighter to lift and move carrier 10 without injury to the fire fighter and without damage to carrier 10. The central location of handles 25*a*, 25*b* also enables a fire fighter to lift and move carrier 10 more rapidly and easily.

Two or more fire fighters may carry carrier apparatus 10 by its handles. As many as six fire fighters can carry apparatus 10 when necessary by use of the six handles as a result of a particularly heavy victim being positioned within carrier 10.

In instances where carrier apparatus 10 must be carried into an elevator, it may be stood on end wall 12. This will take up a minimum of floor space. Carrier apparatus 10 is sufficiently rigid that it will not collapse, or fall over, if steadied by the fire fighter. Since the carrier has a height of approximately five feet, the fireman may pick up vertical-standing carrier 10 with one hand, thereby affording great advantage when, as often happens, the fireman is carrying other equipment with the other hand.

Carrier apparatus 10 is highly useful as both a carrier for fire hose and as a carrier for a victim, thereby providing a carrier for a victim at the fire site, without the need for transporting to the fire site an additional piece of equipment. This is highly important, because every man at a fire site is burdened and has many tasks to perform. Carrier body 10 will enable the transporting of a victim from the fire site either by a single fire fighter, or, if available, a plurality of fire fighters. The victim will be held relatively securely and will be transported in a manner that is not likely to injure the victim during transportation from the fire site.

Further, carrier apparatus 10 may be transported with some degree of comfort by a single fireman, the carrier apparatus, including the fire hose, being relatively rigid, and of sufficient height that it may be picked up by a fireman simply by bending over and grasping centrally located handles 25*a*, 25*b*.

At the fire site, opening of carrier 10 is readily effected by manipulation of the securing straps thereon, after which the connection of the hose to a stand pipe or other source of water may readily be made by one fire fighter while another proceeds with the nozzle to the fire site.

The invention in its broader aspects is not limited to the specific details shown and described, and departures may be made from such details without departing from the principles of the invention and without sacrificing its chief advantages.

What is claimed is:

1. Carrier apparatus for use by fire fighters, said apparatus comprising:

an elongate bottom, a first end wall connected to said bottom and first and second opposed and spaced apart side walls connected to said bottom and to said first end wall;

a second end wall movably connected to said first side wall and extending substantially the entire distance between said spaced apart first and second side walls;

first means in operative relationship with said second end wall and with said second side wall for removably fastening said second end wall to said second side wall;

a plurality of handles connected to each of said first and second side walls for lifting and carrying said carrier apparatus and any load supported by said carrier apparatus;

a plurality of straps connected to one of said side walls and extending to said other one of said side walls;

second means in operative relationship with said straps and with said other one of said side walls for releasably securing said straps to said other one of said side walls;

wherein said second end wall defines a lower edge and wherein said lower edge is normally spaced apart from said bottom to form a gap therebetween when said second end wall is removably fastened to said second side wall, whereby water and debris can pass out through said gap to prevent trapping and collecting of water and debris within said apparatus; and wherein said first and second side walls each defines a free edge remote from said bottom and wherein said second end wall defines an upper free edge opposite from said lower edge, said upper free edge positioned in coplanar relationship with said free edges of said side walls when said second end wall is removably fastened to said second side wall.

* * * * *